US008371886B1

(12) United States Patent
Strangfeld

(10) Patent No.: US 8,371,886 B1
(45) Date of Patent: Feb. 12, 2013

(54) EFFICIENT PADDLE AND ASSOCIATED METHODS

(75) Inventor: Bruce Strangfeld, Eau Claire, WI (US)

(73) Assignee: Ugly Duck Gear, LLC, Eau Claire, WI (US)

( * ) Notice: Subject to any disclaimer, the term of this patent is extended or adjusted under 35 U.S.C. 154(b) by 209 days.

(21) Appl. No.: 12/772,706

(22) Filed: May 3, 2010

Related U.S. Application Data

(63) Continuation-in-part of application No. 29/354,584, filed on Jan. 26, 2010.

(51) Int. Cl.
*B63H 16/04* (2006.01)

(52) U.S. Cl. ..... 440/101

(58) Field of Classification Search ..... 440/101
See application file for complete search history.

(56) References Cited

U.S. PATENT DOCUMENTS

| | | | | |
|---|---|---|---|---|
| 678,193 | A | 7/1901 | Peterson | |
| 1,083,595 | A | 1/1914 | Crawford | |
| 2,779,077 | A | 1/1957 | Kline | |
| 2,898,611 | A | 8/1959 | Mooney | |
| 2,980,926 | A | 4/1961 | Louis | |
| D224,983 | S | 10/1972 | Bolden, Jr. | |
| 3,800,734 | A | 4/1974 | Whang | |
| 4,250,584 | A | 2/1981 | Korn | |
| 4,264,994 | A | 5/1981 | Carbone | |
| D260,254 | S | 8/1981 | Heller | |
| 4,302,194 | A * | 11/1981 | Perales | 440/13 |
| 4,303,402 | A * | 12/1981 | Gooding | 440/101 |
| 4,810,217 | A | 3/1989 | Bell | |
| 5,348,503 | A | 9/1994 | Fechtner | |
| D370,657 | S | 6/1996 | Block, Jr. | |
| 5,649,845 | A * | 7/1997 | Fechtner | 441/56 |
| 6,241,567 | B1 | 6/2001 | Evans | |
| 6,514,109 | B1 | 2/2003 | Carlow | |
| 6,755,706 | B1 | 6/2004 | Lin | |
| 6,814,640 | B1 | 11/2004 | Houck | |
| 7,037,151 | B1 | 5/2006 | Fan | |
| 7,309,364 | B1 | 12/2007 | Wagenknecht et al. | |
| 7,488,228 | B2 | 2/2009 | Scott | |
| 2002/0061690 | A1 | 5/2002 | Evans | |
| 2005/0101200 | A1 * | 5/2005 | Townsend | 440/101 |
| 2009/0004935 | A1 | 1/2009 | Branovits | |
| 2010/0009580 | A1 | 1/2010 | Escobar | |

FOREIGN PATENT DOCUMENTS

WO WO 2009/077778 6/2009

OTHER PUBLICATIONS

Application and File History for U.S. Appl. No. 29/354,584, filed Jan. 26, 2010, inventor Stangfeld.

* cited by examiner

*Primary Examiner* — Stephen Avila
(74) *Attorney, Agent, or Firm* — Patterson Thuente Christensen and Pedersen PA

(57) ABSTRACT

An aquatic paddle includes a shaft having a first end and a second end, and a paddle blade rigidly coupled to the first end of the shaft. The paddle blade is constructed from a skeleton and a web spanning the skeleton. The skeleton includes a hub structure having a proximal end and a distal end, and a plurality of rod members. Each rod member is rigidly secured at the distal end of the hub structure. The proximal end of the hub structure is rigidly secured to the first end of the shaft.

17 Claims, 31 Drawing Sheets

Carbon Fiber Rods

| Force Applied to Shaft (Lbf) | Flow Exit Surface Area Max. Cross-sectional ($in^2$) | Blade Volume ($in^3$) |
|---|---|---|
| 0 | 0.00 | 0.00 |
| 1 | 8.61 | 32.26 |
| 2 | 12.45 | 46.64 |
| 3 | 15.60 | 58.45 |
| 4 | 18.42 | 69.01 |
| *5* | *19.95* | *74.76* |
| 6 | 21.48 | 80.50 |
| *7* | *21.89* | *82.04* |
| 8 | 22.30 | 83.56 |
| *9* | *22.21* | *83.23* |
| 10 | 22.12 | 82.90 |
| *11* | *22.02* | *82.52* |
| 12 | 21.92 | 82.13 |
| *13* | *22.05* | *82.63* |
| 14 | 22.18 | 83.12 |

*FIG. 8A*

Rods

| Example Rod Geometry | Average (inch) | Minimum (inch) | Maximum (inch) |
|---|---|---|---|
| Diameter [1] | 0.188 | 0.125 | 0.250 |
| Length | 18.0 | 15.0 | 21.0 |

| Rod Material Properties (Examples) | Young's Modulus Typical (psi) | Young's Modulus Minimum (psi) | Young's Modulus Maximum (psi) |
|---|---|---|---|
| **Composites:** | | | |
| Fiberglass (unidirectional fibers) | 6.150e6 | 5.800e6 | 6.500e6 |
| Carbon Fiber (unidirectional fibers) | 1.958e7 | 1.741e7 | 2.176e7 |
| Carbon Fiber/Nanotube | 1.45e8 [2] | | |
| **Metals:** | | | |
| Titanium | 1.624e7 | 1.490e7 | 1.653e7 |
| Aluminum | 1.040e7 | 9.993e6 | 1.059e7 |

[1] Solid rod, not tubular in cross-section, for all material types

[2] Data on carbon fiber composites constructed of carbon nanotubes is preliminary at this time

*FIG. 9A*

Hub

| Hub Material List (Examples) | Applicable Hub Material Properties |
|---|---|
| **Thermoset Polymers:** | excellent abrasion resistance |
| Urethane | excellent impact resistance |
| **Thermoplastic Polymers:** | non-hydroscopic |
| Acrylonitrile Butadiene Styrene (ABS) | hard/rigid |
| Polyethylene Terephthalate Polyester (PET) | good UV resistance or paintable |
| Polycarbonate (PC) | good resistance to chemicals (solvents, acids, bases, oils) |
| Acetal | good dimensional stability |
| **Metals:** | high mechanical strength |
| Aluminum | |
| Magnesium | |
| Titanium | |

*FIG. 9B*

Web

| Web Material (Examples) | Applicable Web Material Properties |
|---|---|
| Pack Cloth Fabric (Urethane coated nylon) | excellent abrasion resistance |
| Cordura® Fabric (Nylon) | excellent tear resistance |
| Cordura® Fabric (Polyester) | durable |
| Cordura® Ballistic Fabric (Nylon) | lightweight |
| Kevlar® Fabric (Para-aramid) | low hydroscopic (water absorption) |
| Spectra® Fabric (UHMW Polyethylene) | good UV resistance |
| Twaron® Fabric (Para-aramid) | low Modulus of Elasticity |
| Dyneema® Fabric (UHMW Polyethylene) | good resistance to chemicals (solvents, acids, bases, oils) |
| Anso-Tex Fabric (Nylon) | |

*FIG. 9C*

Example Procedure for measuring k, the spring constant, of Titanium and Carbon Fiber Rods

1) Clamp rods under test on proximal end to prevent any movement in XYZ axes
2) Distal end of said rods is free to move in all axes
3) Connect a known mass to the rod distal end and record the deflection
4) Using Hooke's Law, calculate k where $k = F/x$

*F:* Force Applied

*K:* Force Constant, or Spring Constant

*X:* Spring Deflection

5) Calculate an average value of k

| | Titanium Rod | | Carbon Fiber Rod | |
|---|---|---|---|---|
| **Force Applied** | **Deflection** | ***Spring Constant*** | **Deflection** | ***Spring Constant*** |
| **F (Lbs)** | **x (cm)** | ***k (N/m)*** | **x (cm)** | ***k (N/m)*** |
| 4.00 | 16.0 | *111.206* | 13.0 | *136.868* |
| 3.00 | 12.5 | *106.757* | 10.5 | *127.092* |
| 2.00 | 9.0 | *98.849* | 7.0 | *127.092* |
| 1.00 | 4.5 | *98.849* | 3.5 | *127.092* |
| | ***average k (N/m) =*** | ***103.915*** | ***average k (N/m) =*** | ***129.536*** |

*FIG. 10A*

Example Procedure for calculating Elastic Energy for a Given Deflection of a Single Rod

Solve for E where $E = 0.5k*x^2$

*E:* Energy Stored

| Titanium Rod | | Carbon Fiber Rod | |
|---|---|---|---|
| Deflection | Energy Stored | Deflection | Energy Stored |
| x (m) | *E (J)* | x (m) | *E (J)* |
| *0.160* | *1.330* | 0.130 | *1.095* |
| *0.125* | *1.012* | 0.105 | *0.714* |
| *0.090* | *0.525* | 0.070 | *0.317* |
| *0.045* | *0.131* | 0.035 | *0.079* |

*FIG. 10B*

Example Procedure for Determining Elastic Energy for a 3-Rod Paddle Blade

The center rod will deflect twice as far as the outer two rods since it shares the force applied to both webs

| Titanium Rod Deflection | | | Titanium Blade |
|---|---|---|---|
| Outer Rod | Center Rod | Outer Rod | Energy Stored |
| 0.5x (m) | x (m) | 0.5x (m) | E (J) |
| 0.080 | 0.160 | 0.080 | 1.995 |
| 0.063 | 0.125 | 0.063 | 1.218 |
| 0.045 | 0.090 | 0.045 | 0.631 |
| 0.023 | 0.045 | 0.023 | 0.158 |

| Carbon Fiber Rod Deflection | | | CF Blade |
|---|---|---|---|
| Outer Rod | Center Rod | Outer Rod | Energy Stored |
| 0.5x (m) | x (m) | 0.5x (m) | E (J) |
| 0.065 | 0.130 | 0.065 | 1.317 |
| 0.053 | 0.105 | 0.053 | 0.859 |
| 0.035 | 0.070 | 0.035 | 0.382 |
| 0.018 | 0.035 | 0.018 | 0.095 |

*FIG. 10C*

EFFICIENT PADDLE AND ASSOCIATED METHODS

PRIOR APPLICATION

This application is a Continuation-in-Part of U.S. Design patent application Ser. No. 29/354,584, filed Jan. 26, 2010, and entitled "PADDLE BLADE," the disclosure and appendix of which are incorporated by reference into the specification herein.

FIELD OF THE INVENTION

The invention relates generally to marine propulsion and, more particularly, to an aquatic oar or paddle having an efficient blade construction. The invention also relates to methods of making the same.

BACKGROUND OF THE INVENTION

Conventional paddles or oars for facilitating human-powered propulsion of small watercraft such as row boats, canoes, kayaks, and the like, are typically constructed from a tubular shaft with a broad, flat blade at one or both ends thereof. Oars are attached via a pivot to the watercraft and are operated as levers, whereas paddles are held in the operator's hands during use. For the sake of simplicity, where no distinction is meant to be conveyed between paddles and oars, the term "paddle" shall be used hereinafter to refer to either one. Similarly, the actions of paddling and rowing shall be referred to simply as "paddling" where no distinction therebetween is meant to be conveyed.

The shaft and the blade can be integrally formed, as in the case of classical canoe paddles that are made from a single piece of wood; or can be assembled from a plurality of parts using different materials for the various components. For example, some conventional paddles have a lightweight shaft made from aluminum tubing with one or two paddle blades at one or both ends made from a hard plastic material.

Most often, the blades used in paddles or oars are constructed from a rigid, inflexible material that mostly retains its shape during paddling. Accordingly, for these types of paddles, any deformation of the blade as a result of the interaction forces between the blade and the water during paddling is marginal at most. When a hard, non-compliant paddle blade is drawn through the water during paddling, the paddle blade face pushes water in a direction opposite the direction in which the watercraft is to be propelled. Much of the water against which the paddle blade presses flows over the face of the paddle blade towards its edges, and past its edges. The water flowing over the face of the paddle blade flows from a relatively high-pressure zone at the face of the blade to a relatively low pressure zone past the edge of the blade. This flow is turbulent, and the pressure change creates eddy currents in the wake of the paddle stroke. The turbulence and eddy currents are a source of energy loss due to some of the paddling energy being taken up by the mixing, internal friction, and whirling of the water.

In some paddles, the paddle blade is designed to deform to some extent by virtue of the material from which the blade is formed. This type of deformation may be useful to prevent breakage of the blade that might occur when the blade strikes a rock or other hard object during use. However, deformation resulting from water pressing against the paddle blade's face during paddling in these types of paddles dissipates some of the paddling energy, thereby presenting an inefficiency. Additionally, flexible paddle blades suffer from the energy loss associated with the turbulence and eddy currents described above.

There have been various paddle designs proposed to improve paddling efficiency. U.S. Patent Application Publication No 2010/0009580 (Gomez Escobar) discloses a flexible oar having a blade with a hard edge and a soft, resilient, flexible core that stretches to create a pocket of water during rowing, thereby increasing the surface in contact with the water. However, the proposed design creates a turbulent flow that spills over all of the edges of the pocket, resulting in mixing and internal friction in the water, and eddy currents in the oar blade's wake.

U.S. Pat. No. 4,303,402 (Gooding) discloses a paddle with a cup-shaped blade displaced at an angle relative to the shaft for increased efficiency. The paddle blade has sidewalls that tend to scoop water like a spoon. However, the paddle blade maintains a constant non-flat shape, which presents additional drag against the water while the paddle is raised and lowered into the water during paddling. Moreover, as with the Gomez Escobar paddle design, water spills over the sidewalls during paddling, which creates turbulence and eddies.

U.S. Pat. No. 6,814,640 (Houck) discloses swimming fins having a web portion with a plurality of support members. The fins are designed such that their shape changes as the swimming action alternates between the power stroke and return stroke. As with all fins, they are used entirely underwater (i.e. not removed and re-inserted as with paddling), with the major fin surfaces being oriented generally parallel to the direction of travel. Flexure of the fins is designed to force water in the backwards direction, so the fins are generally made to be rather soft. These characteristics make fin designs generally unsuitable for use as paddle blades, since the latter are designed to exert a force against the water while the blade is oriented generally perpendicularly to the direction of travel.

U.S. Pat. No. 4,302,194 (Perales) discloses a combined propulsion and support device for a swimmer. The device is designed with a pair of opposing paddle blades on opposite ends of diametrically opposed tubular arms, with a flotation device in the center. The swimmer holds on to the arms, and paddles with the blades in alternating fashion. The paddle blades are triangular in shape and are slidably mounted in the arms and are constructed with ribs and webs extending therebetween. The ribs and web are designed to permit the blades to collapse and slide into the arms. The combined propulsion and support device is geared to work with an individual swimmer moving at a relatively slow speed. The design of the device does not provide a solution for efficient propulsion of watercraft, which have a greater mass and speed of travel far in excess of the individual swimmer. Particularly, the flexibility of the ribs needed to facilitate collapsibility into the arms, and the slidable arrangement of the blades inside the arms, provide a non-rigid, spring-loaded coupling between the paddle blades and the arms. While paddling, movement of the blades relative to the arms, and the associate friction, dissipate applied energy and make the device unsuitable for use in propelling watercraft efficiently.

Although these, and various other attempts have been made to improve the efficiency, portability, and storage of aquatic propulsion devices, each has its own drawback that results in either a compromise of performance, or makes the approach unsuitable for use with watercraft that are paddled or rowed.

SUMMARY OF THE INVENTION

Aspects of the invention are directed to a paddle having a stiff elastic paddle blade that changes form during paddling to channel water to the distal end, thereby reducing turbulence in the water on other sides of the paddle blade, thus improving the paddling efficiency. Additionally, aspects of the invention are directed to a paddle blade that stores some of the paddling energy during a power stroke, then releases the stored energy with sufficient force to help propel the watercraft forward.

In one embodiment, an aquatic paddle that includes a shaft having a first end and a second end, and a paddle blade rigidly coupled to the first end of the shaft. The paddle blade is constructed from a skeleton and a web spanning the skeleton. The skeleton includes a hub structure having a proximal end and a distal end, and a plurality of rod members. Each rod member is rigidly secured at the distal end of the hub structure. The proximal end of the hub structure is rigidly secured to the first end of the shaft.

In another embodiment, a paddle for propulsion of a human-powered watercraft through water includes a shaft having a first end and a second end, and a deformable paddle blade having a proximal end, a distal end, and a paddle face. The proximal end is of the paddle blade is coupled to the first end of the shaft. The paddle blade is constructed to have sufficient elasticity and stiffness and a geometry such that: (a) during a power stroke, the paddle blade undergoes elastic deformation in response to water pressing against the paddle face whereby the paddle face changes from a generally flat form into a generally scoop-shaped channel that directs most of the water pressing against the paddle face to the distal end, and the elastic deformation stores a portion of the power stroke's energy; (b) at the end of the power stroke the portion of the power stroke's energy that is stored is released with sufficient force to aid in the propulsion of the watercraft; and (c) during a recovery motion, the paddle face takes the generally flat form.

According to a method for constructing an aquatic paddle according to another aspect of the invention, a shaft and a hub structure rigidly situated at a first end of the shaft are provided, along with a plurality of stiff elastic rod members. A web fabric is engaged with the plurality of rod members such that the web fabric spans across the plurality of rod members. The plurality of rod members are rigidly coupled to the hub structure such that the plurality of rod members protrude from the hub structure in a generally radial and co-planar configuration.

These, and other aspects of the invention produce a practical and efficient paddle for use in propelling small human-powered watercraft. A number of other advantages will become apparent from the following Detailed Description of the Preferred Embodiments.

BRIEF DESCRIPTION OF THE DRAWINGS

The invention may be more completely understood in consideration of the following detailed description of various embodiments of the invention in connection with the accompanying drawings, in which:

FIGS. 8A-8B illustrate paddle dynamics (empirical and interpolated) for an exemplary paddle according to one embodiment.

FIG. 9A illustrates exemplary rod geometry, along with material properties of various materials that may be used to construct the rod members of paddle blades according to various embodiments.

FIG. 9B is a table listing various materials that may be used to form the hub structure of various paddle blades according to embodiments of the invention, along with applicable properties to be considered.

FIG. 9C is a table listing various materials from which the web may be made for various embodiments, along with applicable material properties thereof.

FIGS. 10A-10C depict an example procedure for determining the energy storage for two different paddle blades according to embodiments of the invention.

Figure 1A:
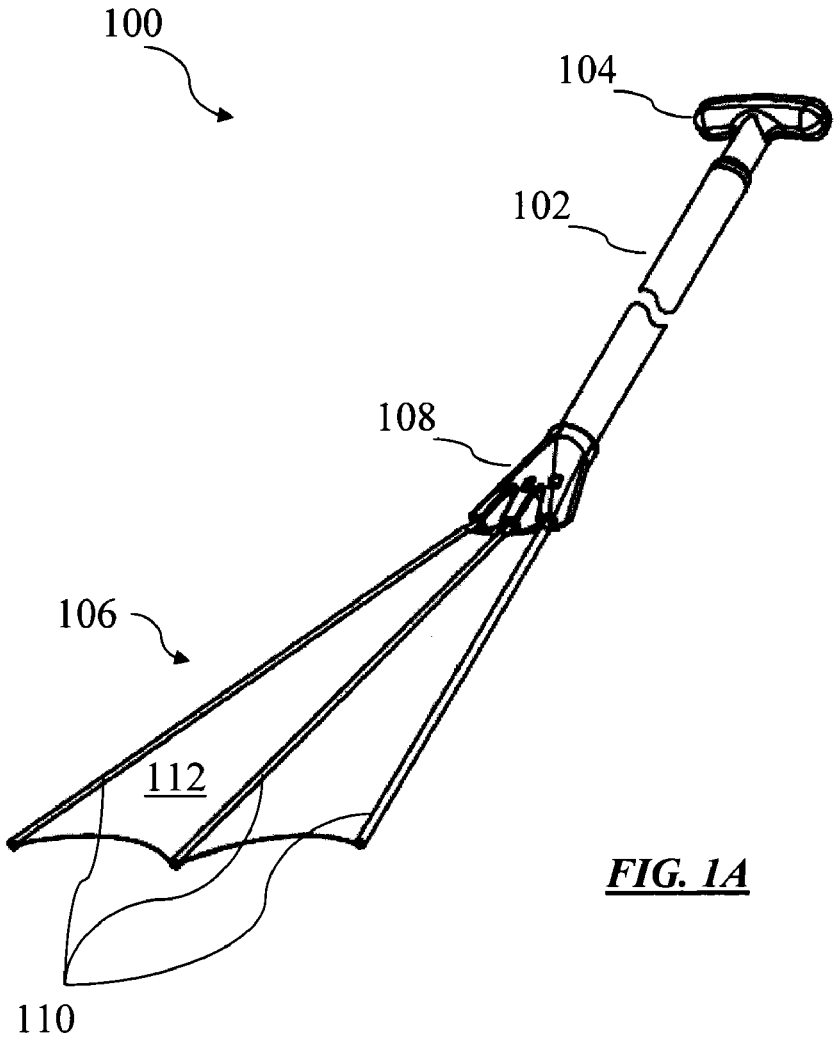
FIGS. 1A and 1B respectively illustrate an exemplary paddle according to one embodiment in perspective and plan views.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

Figure 1B:
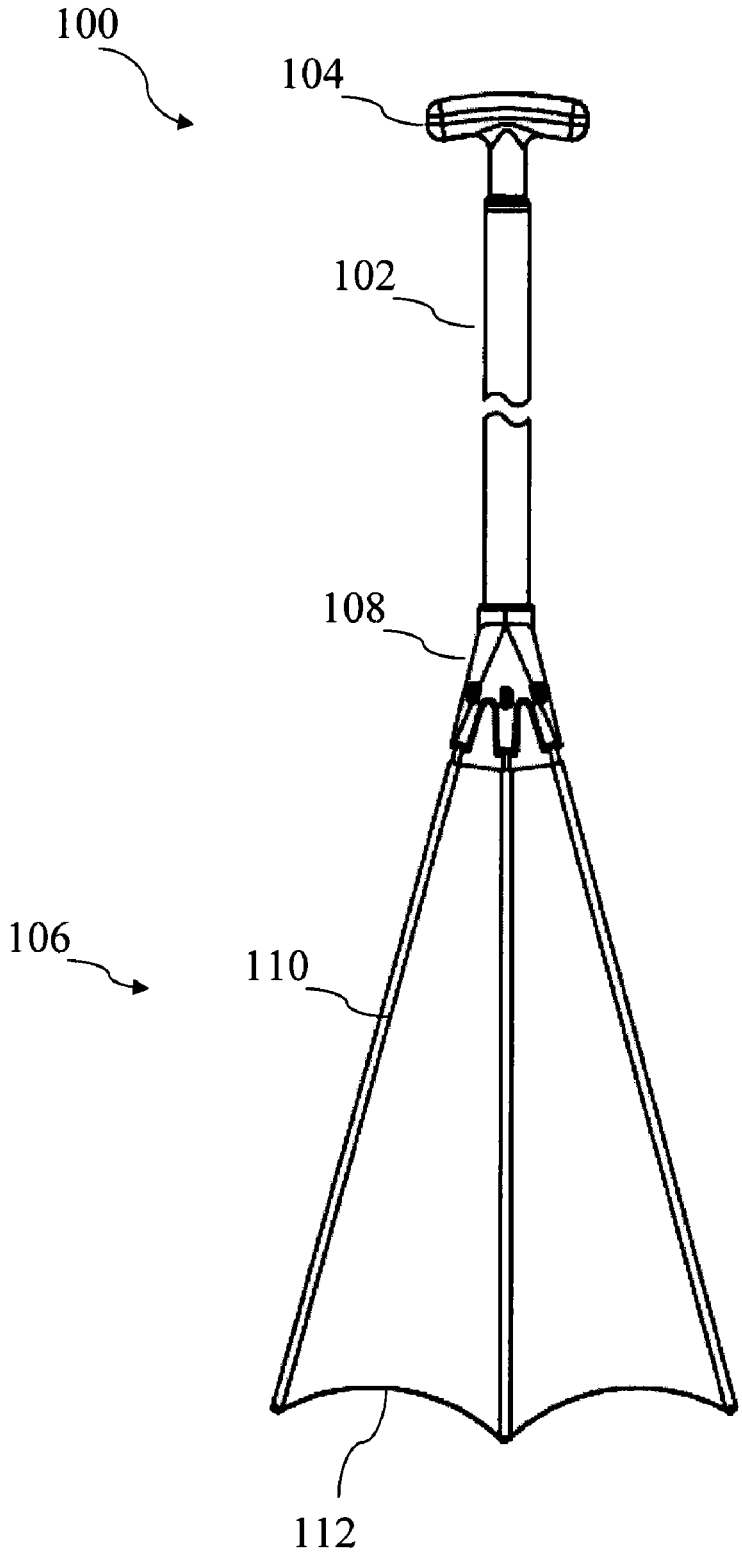

Referring to FIGS. 1A and 1B, an exemplary paddle 100 according to one embodiment is illustrated in perspective and plan views, respectively. Paddle 100 includes shaft 102, which may be in the form of a tube, or any other suitable elongate structure (not necessarily round in cross section). At the proximal end of paddle 100 is handle 104.

At the distal end of paddle 100 is paddle blade 106. Paddle blade 106 is assembled from a skeleton and a web. The skeleton of paddle blade 100 includes hub structure 108 and rod members 110. Web 112 spans rods 110 along nearly their entire length. In the embodiment shown, rod members 110 are generally co-planar with one another. Generally co-planar means that any variations from an ideal planar configuration (such as those which may be due to manufacturing tolerances, for instance) are negligible in terms of overall form or function. In other embodiments, one or more rod members may protrude out of the plane at some angle (for example, the center rod member may protrude out of the plane defined by the outer rods).

In the embodiment shown, the outer rods are oriented relative to one another at an angle of about 30 degrees. In related embodiments, angles of between 20 and 40 degrees may be preferable. In still other embodiments, it is contemplated that larger angles may be used.

Hub structure 108, at its proximal end, is rigidly attached to shaft 102. At its distal end, hub structure 108 engages rigidly with rod members 110. Rigid attachment means that there is negligible motion or flexing between shaft 102 and hub structure 108.

For the attachment of hub structure 108 and shaft 102, variety of ways in which the rigid attachment can be implemented are contemplated according to various embodiments. For example, hub structure 108 and shaft 102 are coupled using mechanical fasteners such as screws or rivets, utilizing a friction fit, utilizing a threaded post and matching receptacle, or utilizing latch features, certain implementations of which may optionally permit disengaging shaft 102 and hub structure 108.

In related embodiments where the hub structure 108 is removable from shaft 102, shaft 102 can have rod retention provisions in the interior for holding rods 110. The rod retention provisions may be used to keep spare rods, or may be used to store disassembled rods. Optionally, the interior of the shaft can have sufficient space in which to store rolled-up web material compactly. The rod retention provisions can take any suitable form, including, for example, clips, foam sleeves, and the like.

In another embodiment for attaching hub structure 108 and shaft 102, a suitable adhesive like an epoxy is used. These types of couplings can optionally make use of a mechanical engagement of mating parts such as male-female pair, which can provide additional contact surfaces, friction fit, and lateral support, all of which add to the rigidity of the coupling. In another type of embodiment, hub structure 108 is welded with shaft 102, which may be possible when the shaft and hub structure are formed from welding-compatible materials. In yet another embodiment, hub structure 108 is integrally formed with shaft 102, which may be achieved through die casting or injection molding, of the layup of composite material, for example.

For the connection between hub structure 108 and rod members 110, hub structure 108 in one embodiment retains rod members 110 in an arrangement where the rods protrude generally radially from hub structure 108. The radial arrangement may be preferable in certain cases, but is not required for all embodiments. To retain the rod members, hub structure 108 may use any of a variety of provisions. For example, a set of cavities (discussed in greater detail below) may be created in hub structure 108 in which rod member 110 are inserted and retained securely. It should be understood, however, that any suitable arrangement for retaining the rods within the cavities may be utilized within the spirit of the invention, such as any of the arrangements discussed above for coupling shaft 102 and hub structure 108.

Figure 2B:
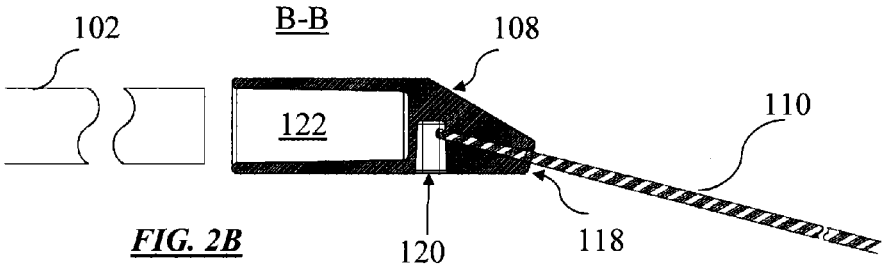
FIGS. 2A-2C illustrate the construction of a hub structure according to one embodiment with FIG. 2A depicting the hub structure as a plan view diagram, FIG. 2B showing a cross-section taken along a plane bisecting the paddle symmetrically along the longitudinal direction, and FIG. 2C depicting the hub structure as seen looking in from the distal end of the paddle.
Figure 2A:
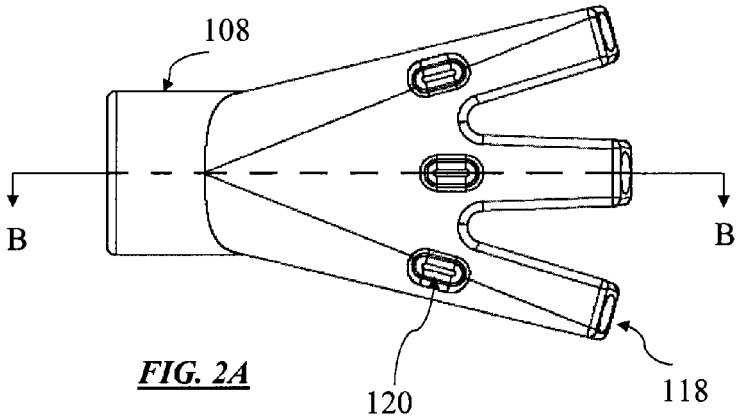
Figure 2C:
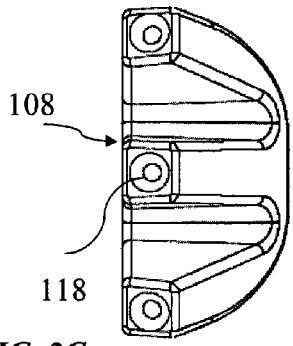
Figure 3A:
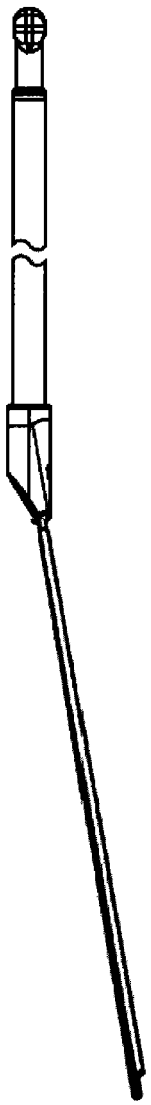
FIGS. 3A-3C illustrate various angles between the paddle blade and shaft according to various embodiments.
Figure 3B:
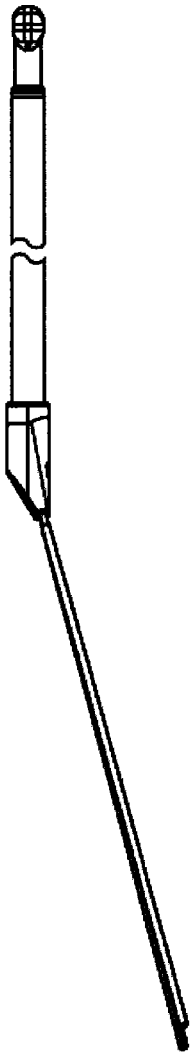
Figure 3C:
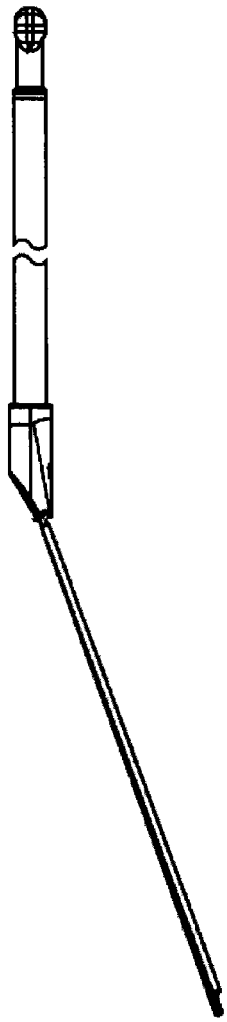

FIGS. 2A-2C illustrate the construction of hub structure 108 according to one embodiment. FIG. 2A illustrates hub structure 108 viewed plan-wise. FIG. 2B is a cross-sectional view diagram taken along a plane bisecting paddle 100 symmetrically along the longitudinal direction. FIG. 2C depicts hub structure 108 as seen looking in from the distal end of paddle 100. Hub structure 108 is formed from a rigid body of bulk material. Cavity 118 accepts rod 110. In one embodiment, cavity 118 is a tapered bore (having a progressively decreasing diameter with bore depth) that friction locks with rod 110. In this arrangement, rod 110 is removable, although the design retains rods 110 with sufficient force to reliably prevent rod 110 from becoming dislodged during ordinary use of paddle 100. In a related embodiment, rods 110 are each retained with such force that a person would not ordinarily be able to remove rods 110 without tools. Cavity 118 extends into cavity 120, which provides access to the inserted tip of each rod 110. Cavity 120 facilitates inserting a removal tool that can be used to apply leverage against the inserted tip of each of rods 110 in order to remove the rod. As can be seen in the embodiment of hub structure 108 depicted in FIGS. 1A and 2A-2C, hub structure 108 holds rods 110 at an angle relative to shaft 102. This angle provides improved paddling efficiency in some embodiments. FIGS. 3A-3C illustrate, respectively, angles of 170, 165, and 160 degrees according to various embodiments. Practically, angles between 160 degrees (20-degree offset) and 180 degrees (no offset) are contemplated, although there may certainly be other embodiments within the spirit of the invention in which the offset angle is greater than 20 degrees.

Figure 4A:
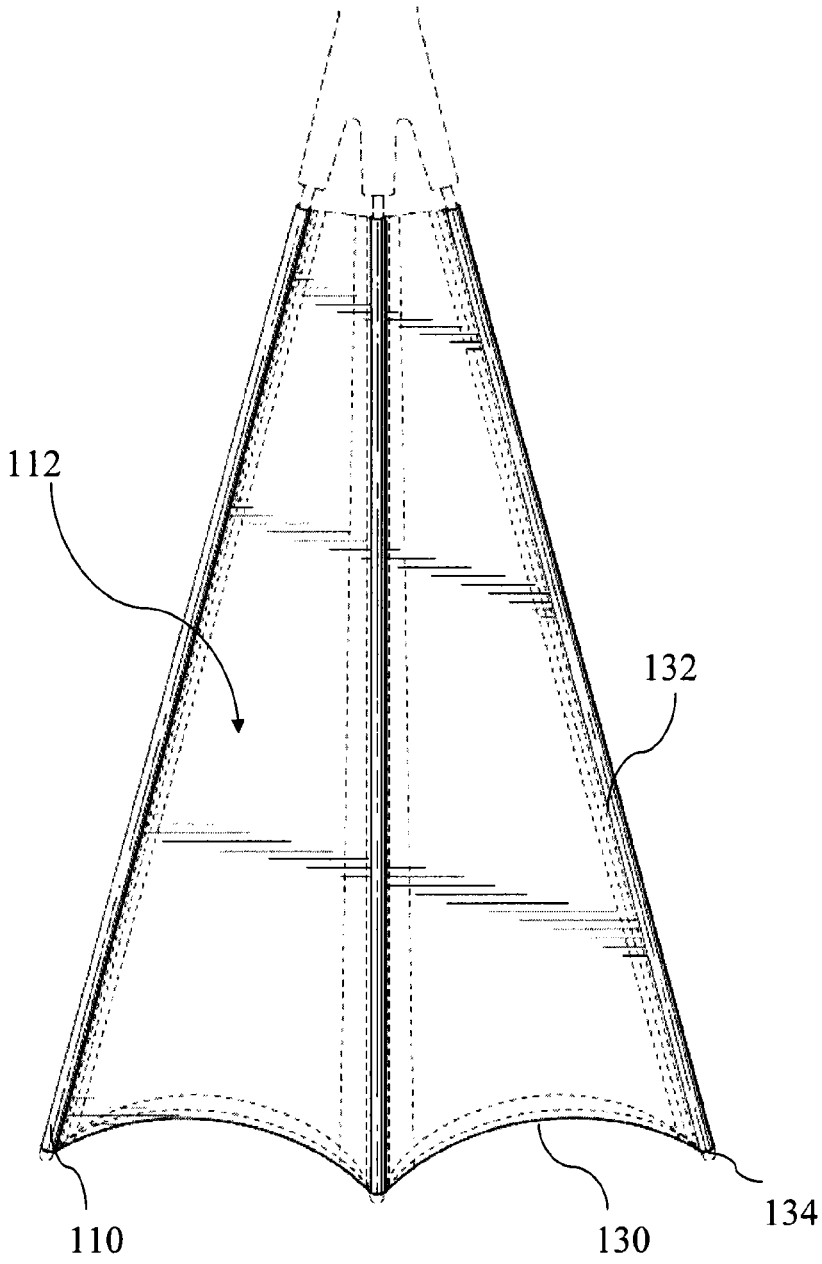
FIGS. 4A and 4B illustrate the web of the exemplary paddle in greater detail according to one embodiment.
Figure 4B:
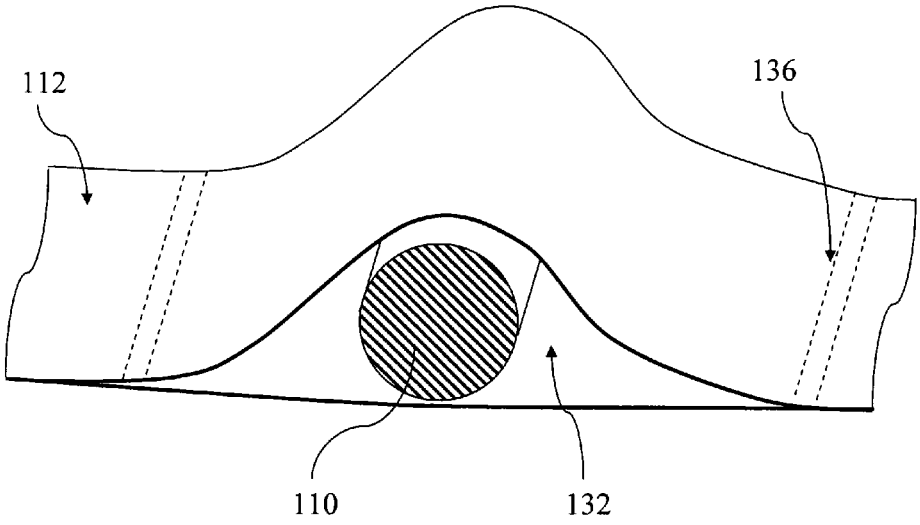

FIGS. 4A and 4B illustrate web 112 in greater detail. In the embodiment depicted in FIG. 4A, web 112 is made from a suitable fabric material that spans rod members 110. At the distal end of paddle 100, web 112 has scalloped edges 130 between adjacent rods 110. In alternative embodiments, various other shapes may be used for the distal edges 130 such as, for example, straight edges, or any other shape suitable for the hydraulic environment and watercraft to be propelled. Web 112 retains rod members 110 inside sleeves 132 that are sewn into web 112. A portion of sleeve 132 is depicted sectionally in greater detail in FIG. 4B. Stitches 136 create sleeve 132 from two layers of material. For rod members 110 which are the outer-most rods, sleeves 132 may be formed by looping the web around the respective rod to create two layers of webbing, and stitching the webbing along the length of the sleeve 132. Functionally, sleeves 132 maintain reliable retention of web 112 to rods 110 along the length of rods 110, while permitting web 112 to pivot on rods 110 freely. This rotatable coupling, or pivoting, permits the face of the paddle blade to take on a specific shape with minimal damping, thereby promoting paddling efficiency.

Referring back to FIG. 4A, in one type of embodiment, as shown, web 112 includes retaining portions 134, in which the distal ends of rods 110 may be inserted. In various examples, retaining portions 134 may be in the form of pockets, or re-closable flaps (such as flaps that loop over and are secured using hook-and-loop fasteners (e.g., Velcro). Retaining portions 134 can serve two separate functions: first, retaining portions 134 provide a protective layer over the ends of rods 110, which provides abrasion and some impact protection for rods 110 that may occur from rock strikes during use, or during transport; second, retaining portions 134 serve as a backup retention mechanism to hold rods 110 in the event that any of rods 110 becomes dislodged from hub structure 108.

Figure 5A:
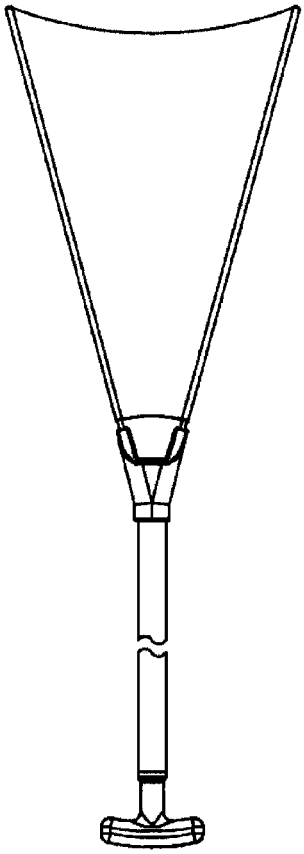
FIGS. 5A and 5B respectively illustrate another embodiment in which the paddle blade is constructed from two rods with a web spanning therebetween.
Figure 5B:
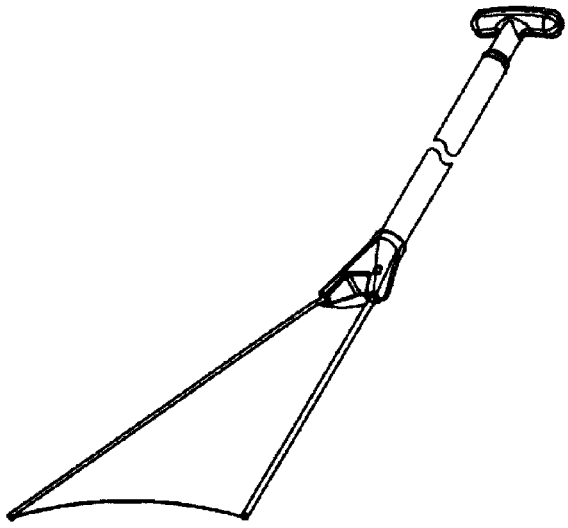

FIGS. 5A and 5B respectively illustrate another embodiment in which the paddle blade is constructed from two rods with a web spanning therebetween. This embodiment demonstrates that a paddle according to aspects of the invention may have any number of rods in the paddle blade's skeleton, be it 2, 3, 4, 5, or more. It will be understood by persons skilled in the relevant arts that the dynamic properties of the paddle blade depend from the material properties of the rods and the overall geometry of the paddle blade. Accordingly, in paddles having different numbers of rods, the number of rods and the stiffness of rods should be selected to provide the desired energy storage and release characteristics suitable for the forces applied during paddling, as well as the weight and speed of the watercraft being propelled.

Figures 1, 6A:
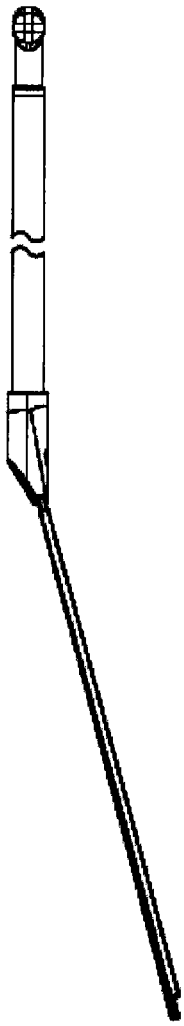
FIGS. 6A-1 through 6B-2 illustrate the dynamic properties of an exemplary paddle according to one embodiment.
Figures 1, 6B:
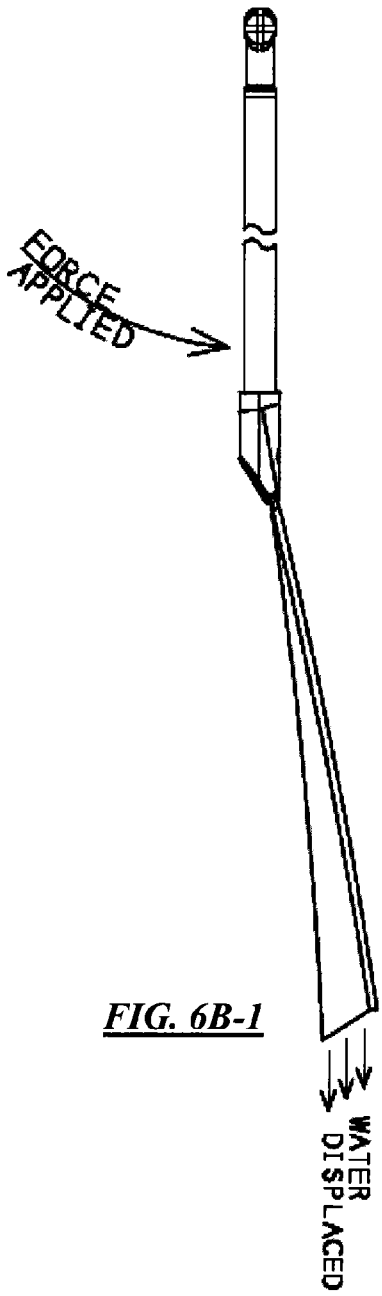
Figures 2, 6A:
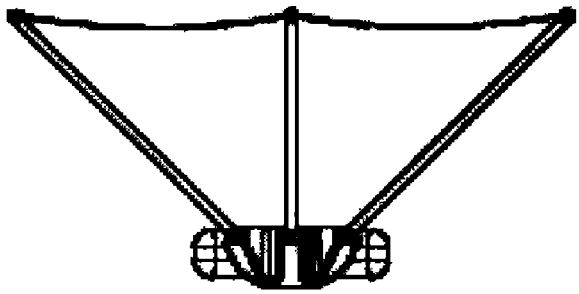
Figures 2, 6B:
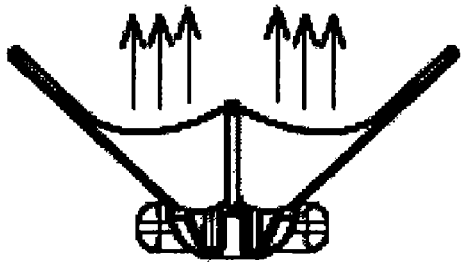

FIGS. 6A-1 through 6B-2 illustrate the dynamic properties of paddle 100. FIGS. 6A-1 and 6A-2 are side view and distal end views, respectively of paddle 100 under zero stress, that is, without any force applied to it. FIGS. 6B-1 and 6B-2 are diagrams showing the same views, respectively as those in FIGS. 6A-1 and 6A-2, except that in FIG. 6B, paddle 100 is in a stressed state as would be the case during a power stroke while paddling a watercraft through a body of water. As can be seen under stress, the paddle blade deflects elastically against the pressure exerted on the face of the paddle by the water against which the paddle is being drawn during the power stroke. Additionally, as can be seen particularly in FIGS. 6B-2, the paddle face changes from a generally flat, planar form into a generally scoop-shaped form. The scoop-shaped form takes the shape of a channel that directs most of the water pressing against the paddle face to the distal end of paddle 100, as represented by the arrows in FIGS. 6B-1 and 6B-2. Channeling the water through the scoop-shaped channel and out through the distal end of paddle 100 creates a more energy-efficient propulsion from the paddling action than had been achieved in previous paddle designs. Since there is less water travelling over the sides of the paddle face, there are fewer eddy currents created.

Furthermore, as the power stroke causes the paddle face to deform elastically, the paddle face stores a portion of the power stroke's energy. At the end of the power stroke, the stored energy is released. Importantly, the paddle is designed in certain embodiments such that the release of energy occurs with sufficient force to aid in the propulsion of the watercraft. Accordingly, in such embodiments, the skeleton of the paddle blade has sufficient stiffness to spring back to the original, un-stressed position at a rate that exceeds the forward velocity of the watercraft. At the end of the power stroke, the paddle blade returns substantially to its original, flat, form, which allows the user to more easily withdrawn the paddle blade from the water for the recovery stroke. During the recovery motion of the paddling cycle, the paddle blade takes the generally flat form, which provides an aerodynamically advantageous shape for pushing the paddle forward through the air in the recovery stroke.

In one embodiment, for a paddle blade designed to be used in a one- or two-person watercraft such as a canoe or kayak, the paddle blade has a spring constant that is greater than 250 newtons per meter. For a paddle blade designed as described above for paddle 100, this spring constant for the paddle blade is defined as the sum of the spring constants of rod members 110. Practically, in related embodiments, the paddle blade has a spring constant that is between 250 and 500 newtons per meter. For other types of watercraft, other spring constants may be appropriate within the spirit of the invention.

Figure 7A:
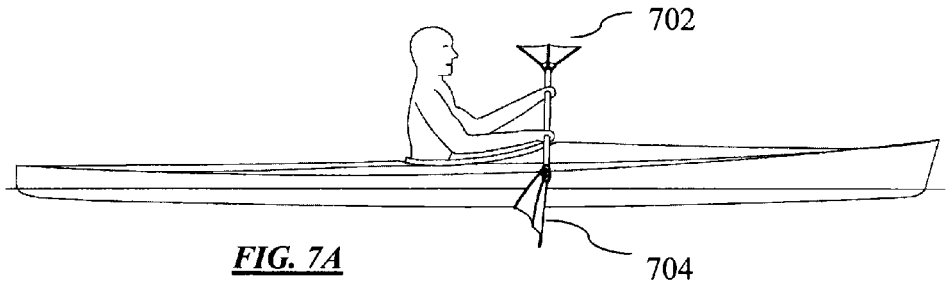
FIGS. 7A-7C are side, top, and front views of a kayaker using a dual-bladed paddle according to one embodiment of the invention.
Figure 7B:
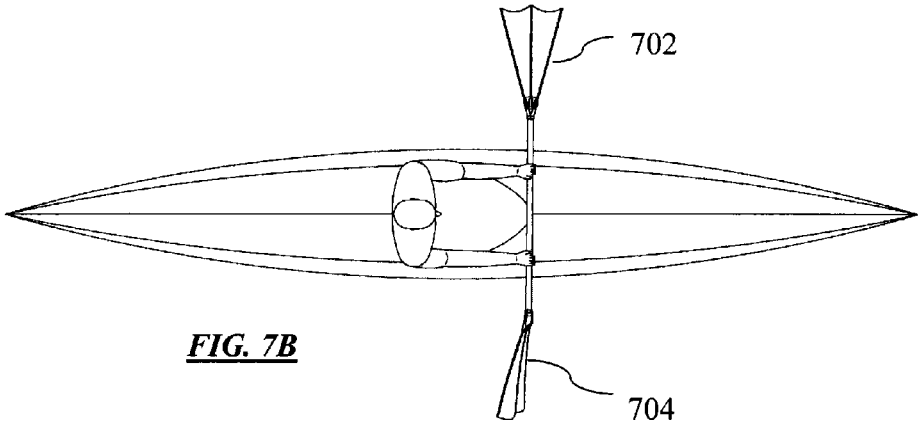
Figure 7C:
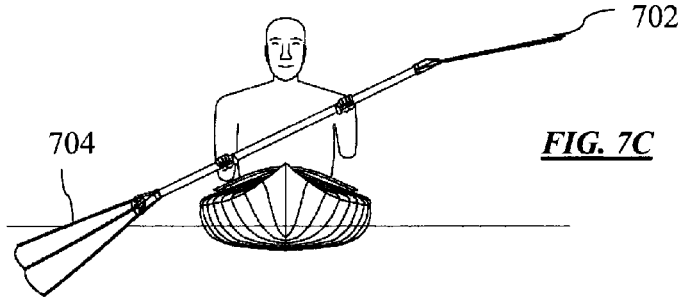

FIGS. 7A-7C are side, top, and front views of a kayaker using a dual-bladed paddle according to one embodiment of the invention. In this embodiment, instead of handle 104, the paddle has a second blade at the other end of the shaft. The two blades, indicated at 702 and 704, are rotationally off-set from one another such that while one blade is oriented optimally for efficient propulsion during the power stroke, the opposite blade is oriented optimally for the recovery motion, i.e., for minimal drag through the air. In the example embodiment shown, the paddle blades are off-set from one another by 60 degrees, whereas in other embodiments, different offsets are contemplated. In the figures, paddle blade 702 is shown in its un-stressed state, whereas paddle blade 704 is shown in its elastically-deformed state while under stress that is applied by the kayaker against the water.

Figure 8B:
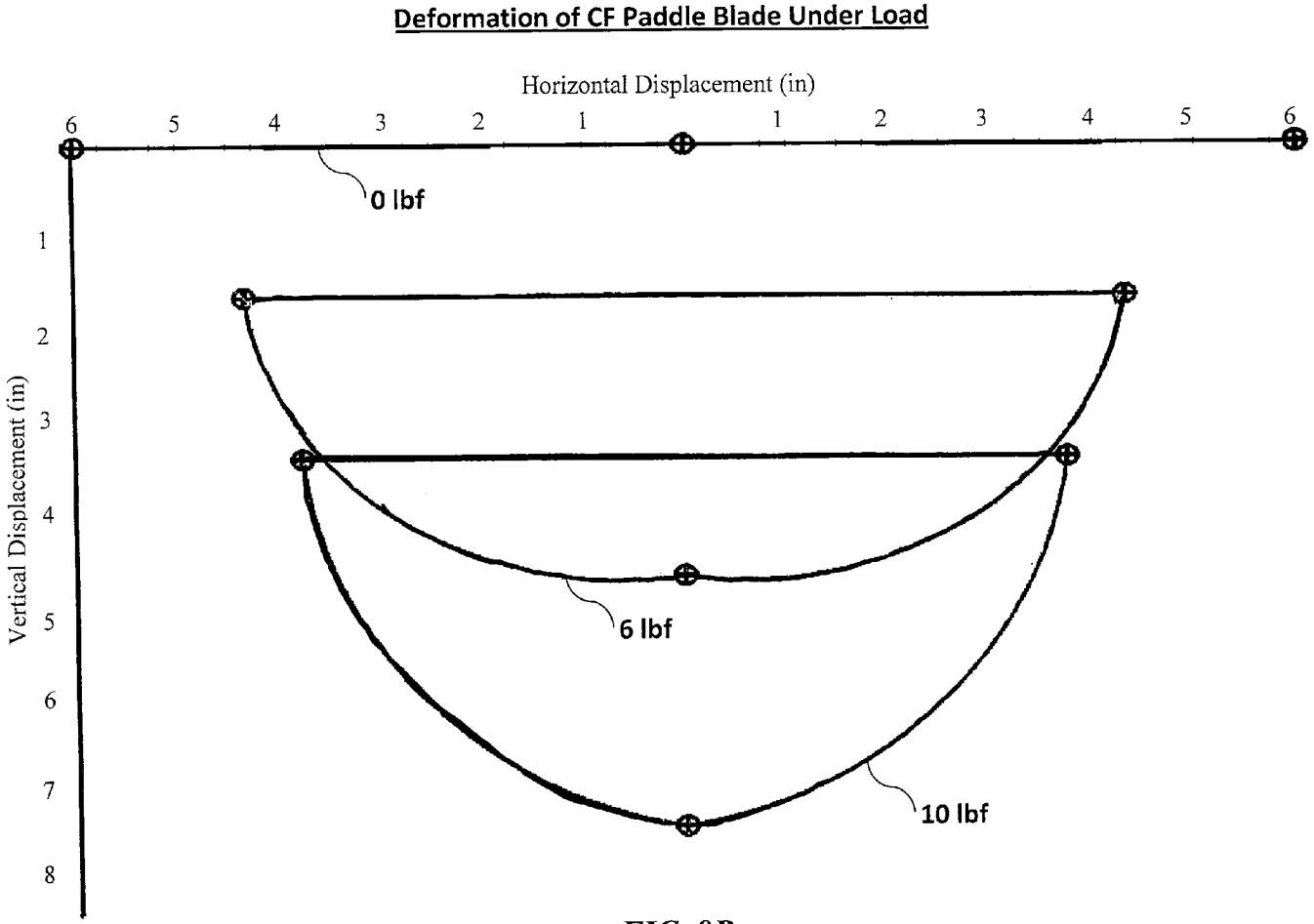

FIGS. 8A-8B illustrate paddle dynamics for a paddle having a blade with carbon fiber rods and a geometry of paddle blade 100. The data is based on empirical and interpolated data points, with the values in italics being interpolated from measured values that are indicated using non-italicized numerals. Referring first to FIG. 8A, the leftmost column, titled Force Applied to Shaft, represents the force applied by the paddler in foot-pounds. The data second column, Flow Exit Surface Area, indicates the corresponding cross-sectional surface area of the scoop created by the elastic deformation of the paddle blade, taken at the distal end of the paddle. This is the exhaust opening size for displaced water. The velocity of the displaced water is disproportional to Blade Surface Area, assuming equal Force Applied. Another way to look at it is the blade shape automatically adjusts itself to an efficient form for most paddler effort levels. The third column, Blade Volume, indicates the total amount of water contained in the scoops of the curved fabric of the blade. More precisely, this is the amount of water contained in the blade web at any instant corresponding to the force being applied.

FIG. 8B is a plot showing the flow exit surface area shape for zero force, 6 foot-pounds of force, and 10 foot-pounds of force. The ⊕ symbol indicates the relative positions of the distal ends of each of the three rod members. The vertical displacement of the rod members is due to flexing of the rods in the direction opposing the direction of the power stroke. The horizontal displacement of the outer two rods is due to the web taking the scoop shape resulting from the center rod deflecting more than the outer rods, thereby causing the web to pull the ends outer rods together.

FIG. 9A illustrates exemplary rod geometry, along with material properties of various materials that may be used to construct the rod members. FIG. 9B is a table listing various materials that may be used to form the hub structure, along with applicable properties to be considered. FIG. 9C is a table listing various materials from which the web may be made, along with applicable material properties thereof.

FIGS. 10A-10C depict an example procedure for determining the energy storage for two different paddle blades: the first constructed using three titanium rods, and the second constructed using carbon fiber rods. From the results of this analysis, it is seen that titanium rods store more energy than Carbon Fiber for the same applied force. For light to moderate conditions, approximate energy stored ranges from about 0.1 to about 0.16 joules for a three-rod paddle blade. For light-to-moderate conditions, approximate energy stored ranges from about 0.38 to about 0.63 joules. For moderate-to-hard conditions, approximate energy stored ranges from 0.86 to about 1.22 joules. For hard paddling conditions, stored energy ranges from about 1.32 to about 2.00 joules, which has been equated to be approximately the kinetic energy of a tennis ball moving at 28 miles per hour.

Figure 11:
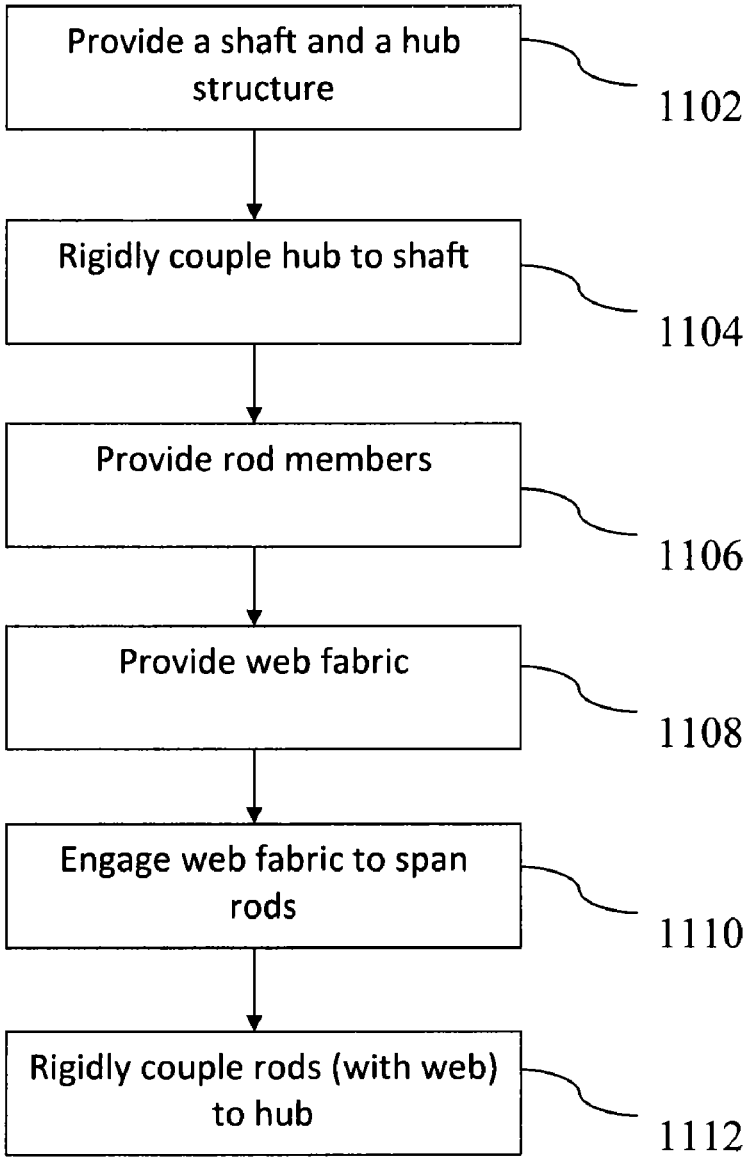
FIG. 11 is a flow diagram illustrating a method of assembling a paddle according to one aspect of the invention.
Figure 12A:
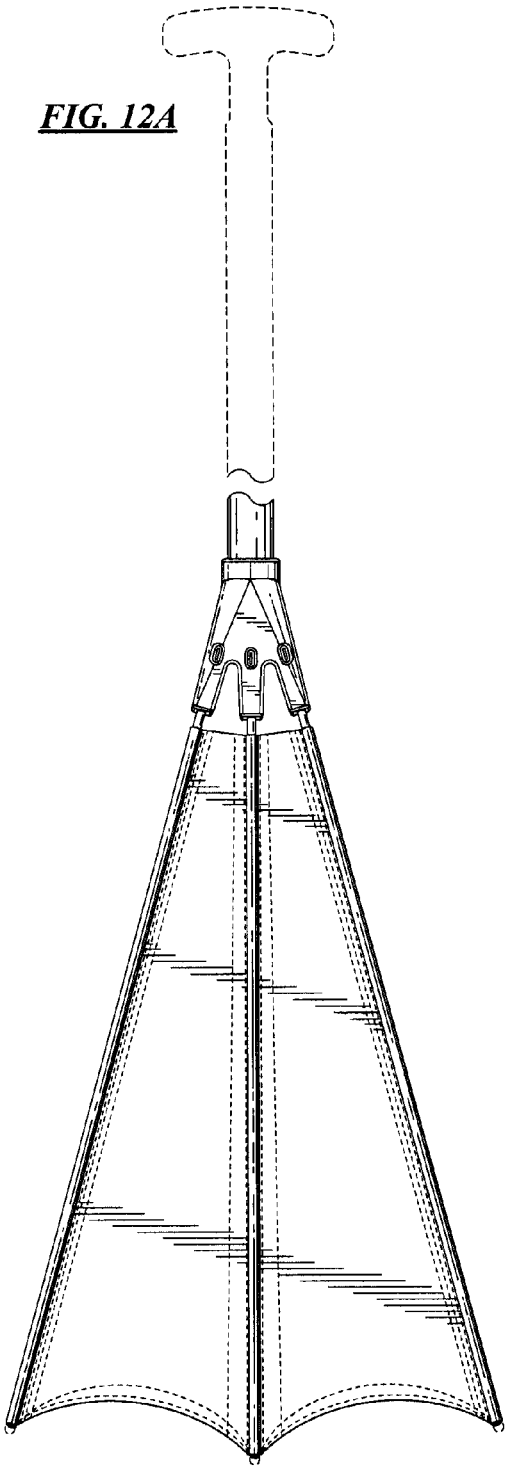
FIGS. 12A-12G depict a paddle design according to one embodiment of the invention, in which the paddle blade is oriented at a relatively small offset angle to the shaft, with FIG. 12A being a front elevational view, FIG. 12B being a left side elevational view FIG. 12C being a right side elevational view, FIG. 12D being a top plan view, FIG. 12E being a bottom plan view, FIG. 12F being a back elevational view, and FIG. 12G being a perspective view of the paddle according to this embodiment.
Figure 12B:
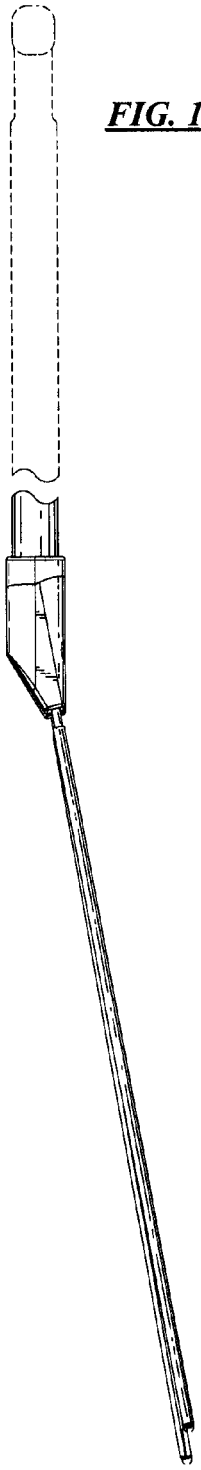
Figure 12C:
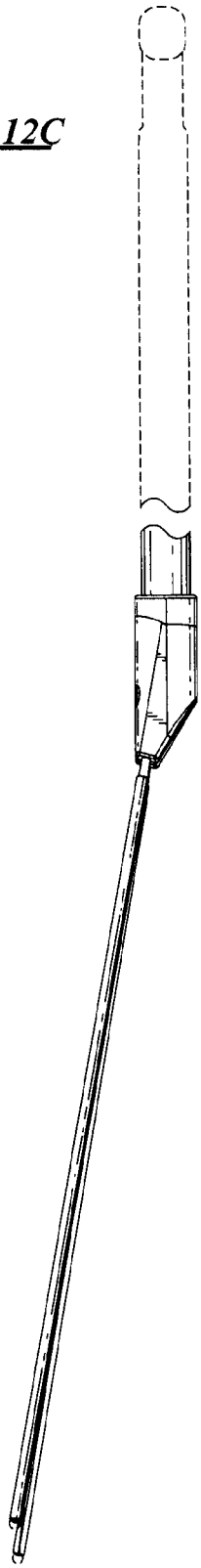
Figure 12D:
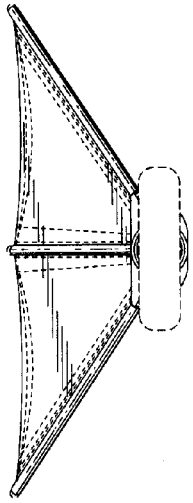
Figure 12E:
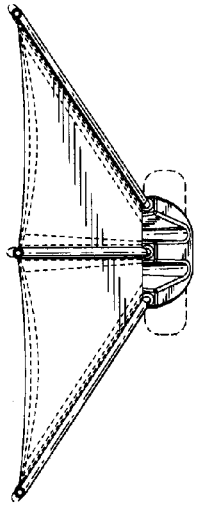
Figure 12F:
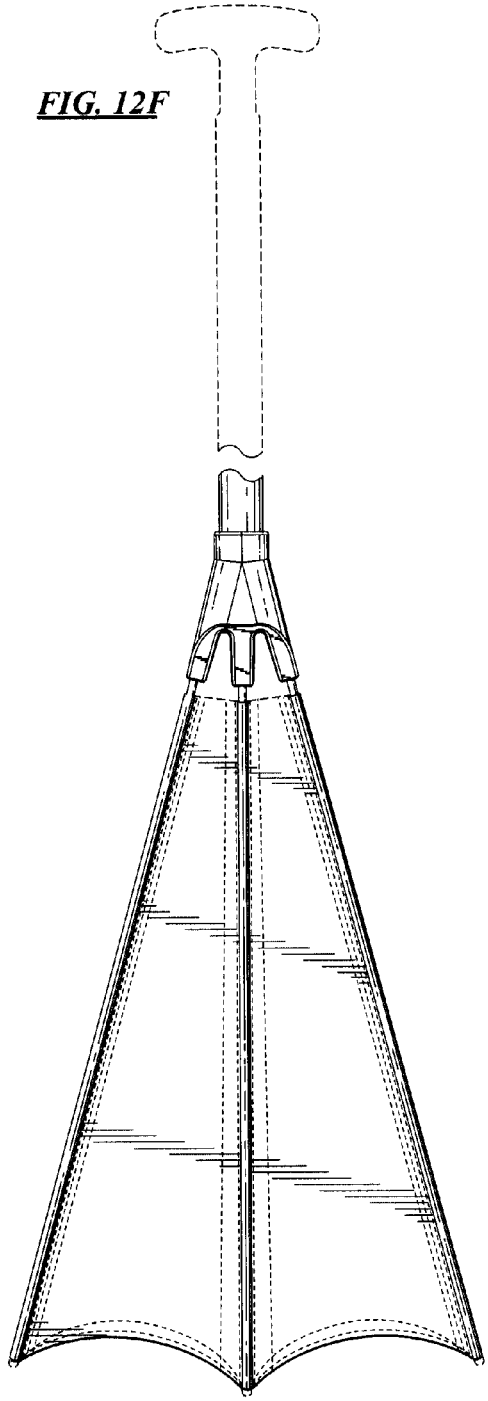
Figure 12G:
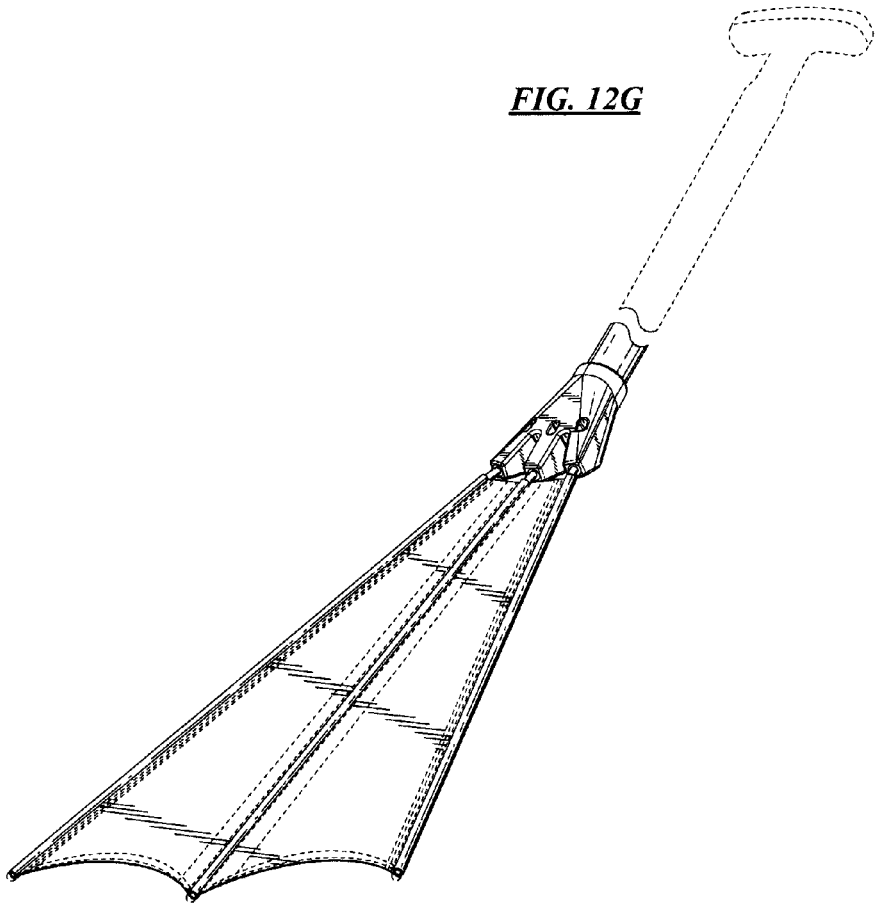
Figure 13A:
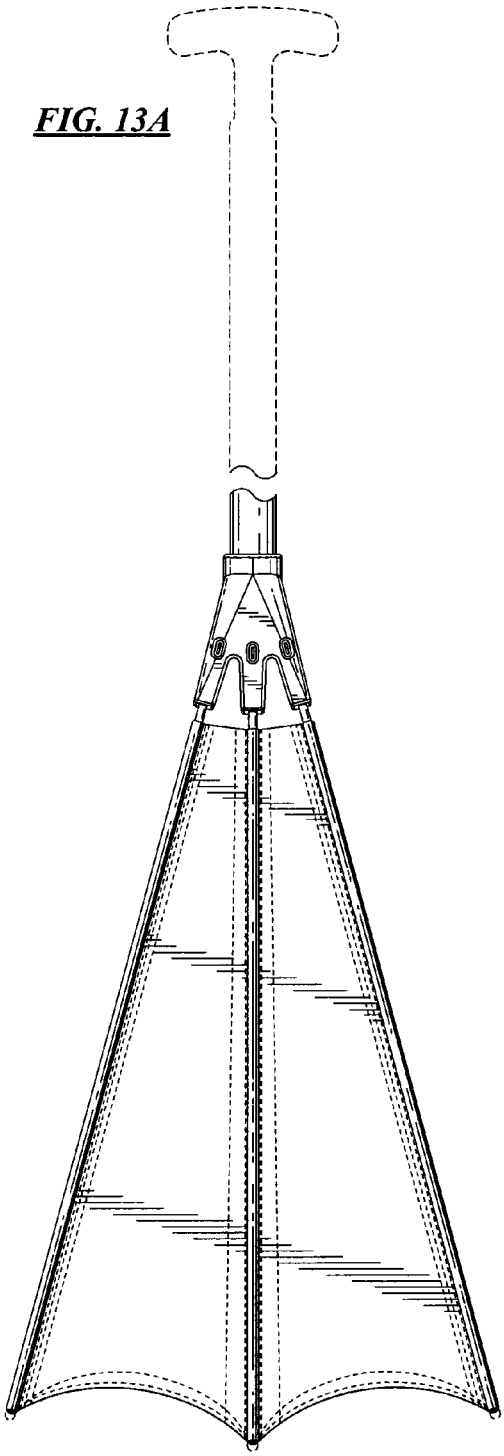
FIGS. 13A-13G depict a paddle design according to another embodiment of the invention, in which the paddle blade is oriented at a relatively moderate offset angle to the shaft compared with that of FIGS. 12A-12G, with FIG. 13A being a front elevational view, FIG. 13B being a left side elevational view FIG. 13C being a right side elevational view, FIG. 13D being a top plan view, FIG. 13E being a bottom plan view, FIG. 13F being a back elevational view, and FIG. 13G being a perspective view of the paddle according to this embodiment.
Figure 13B:
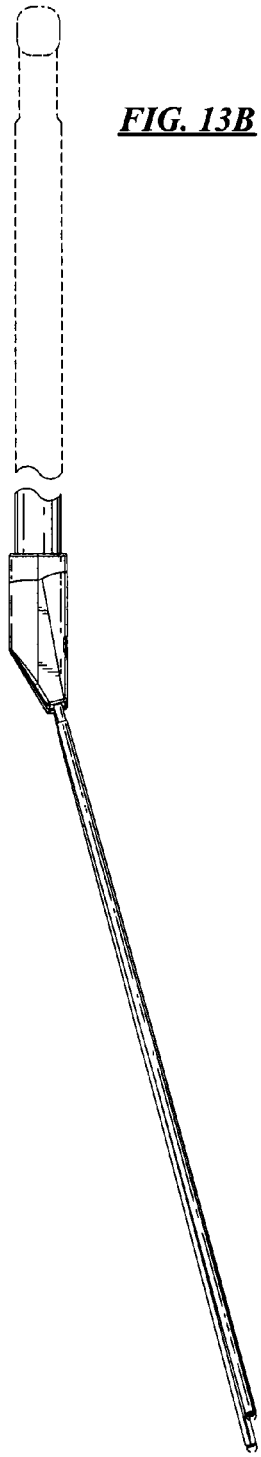
Figure 13C:
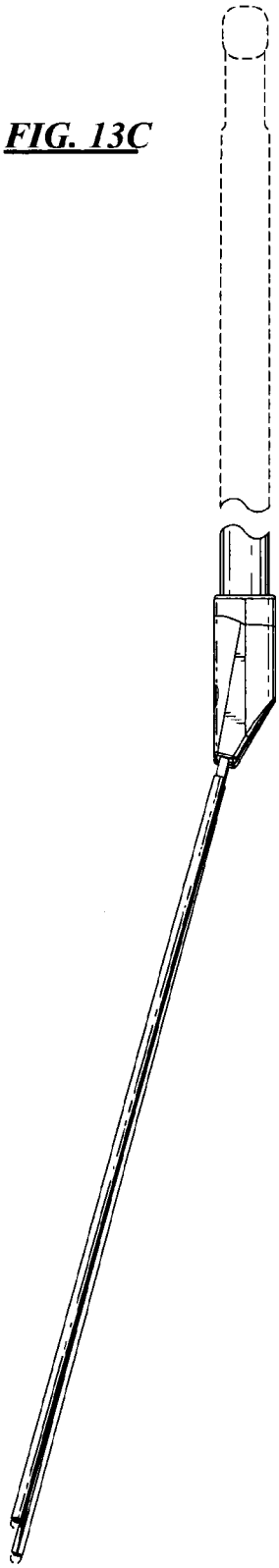
Figure 13D:
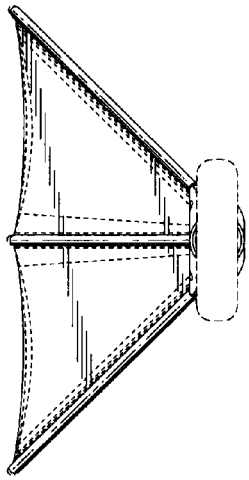
Figure 13E:
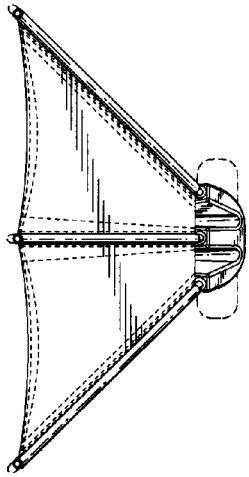
Figure 13F:
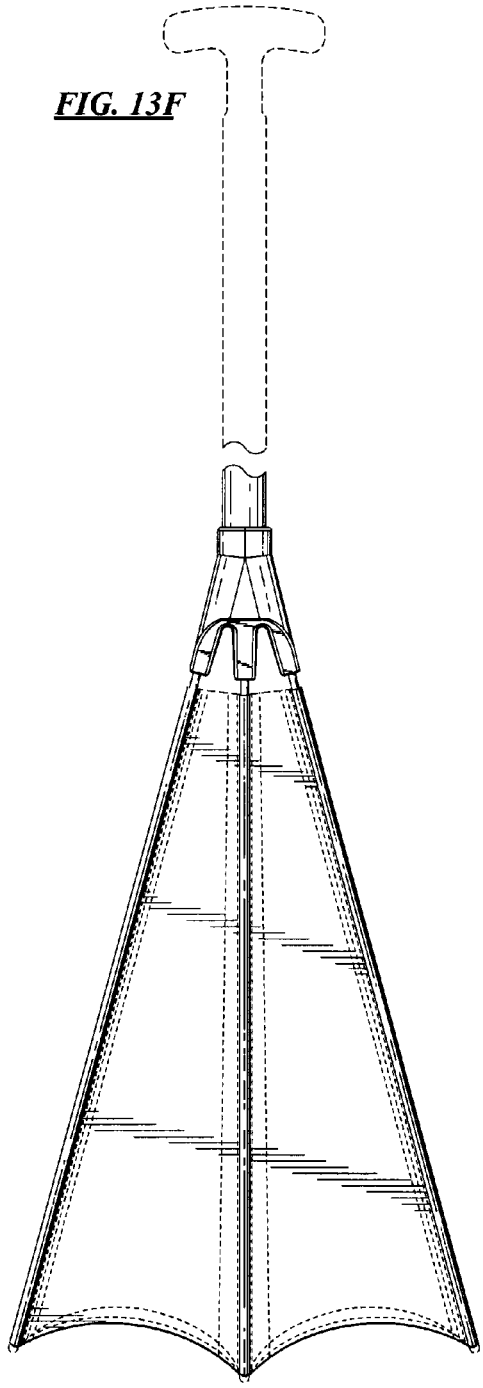
Figure 13G:
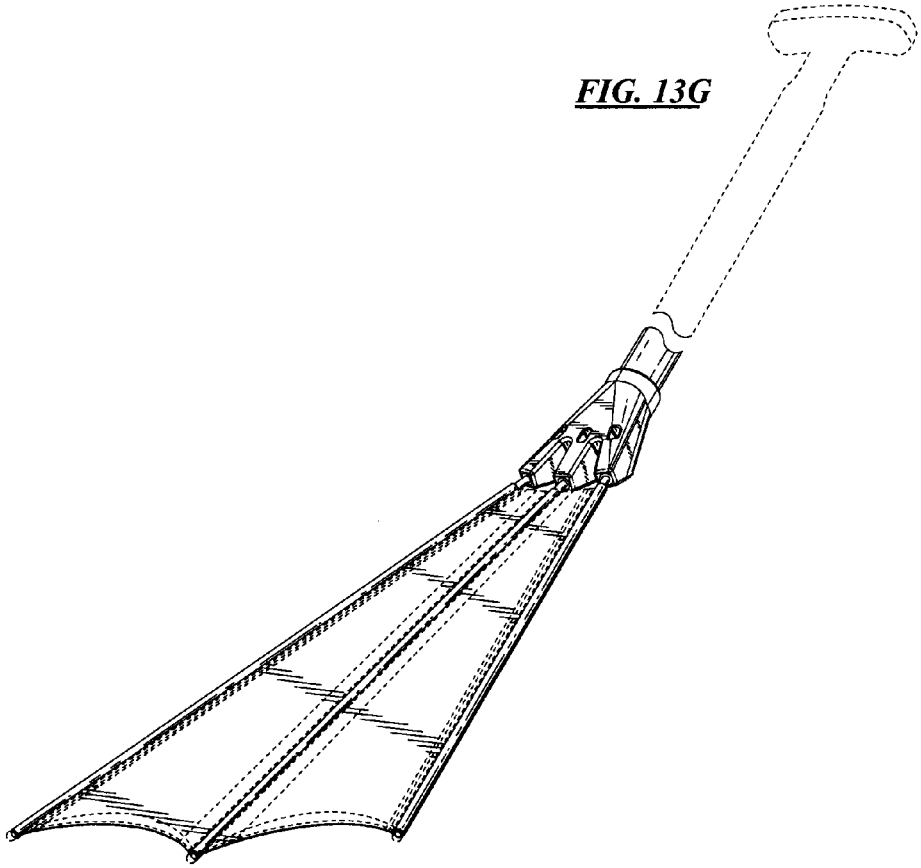
Figure 14A:
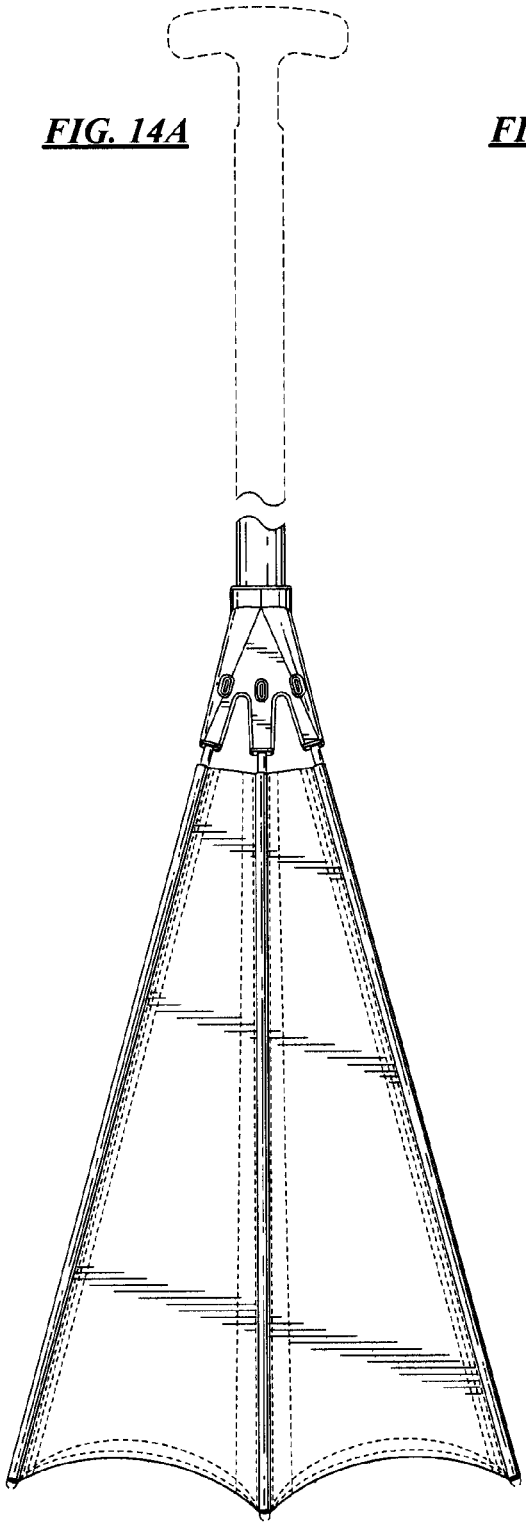
FIGS. 14A-14G depict a paddle design according to another embodiment of the invention, in which the paddle blade is oriented at a relatively larger offset angle to the shaft compared with that of FIGS. 12A-12G, and FIGS. 13A-13G, with FIG. 14A being a front elevational view, FIG. 14B being a left side elevational view FIG. 14C being a right side elevational view, FIG. 14D being a top plan view, FIG. 14E being a bottom plan view, FIG. 14F being a back elevational view, and FIG. 14G being a perspective view of the paddle according to this embodiment.
Figure 14B:
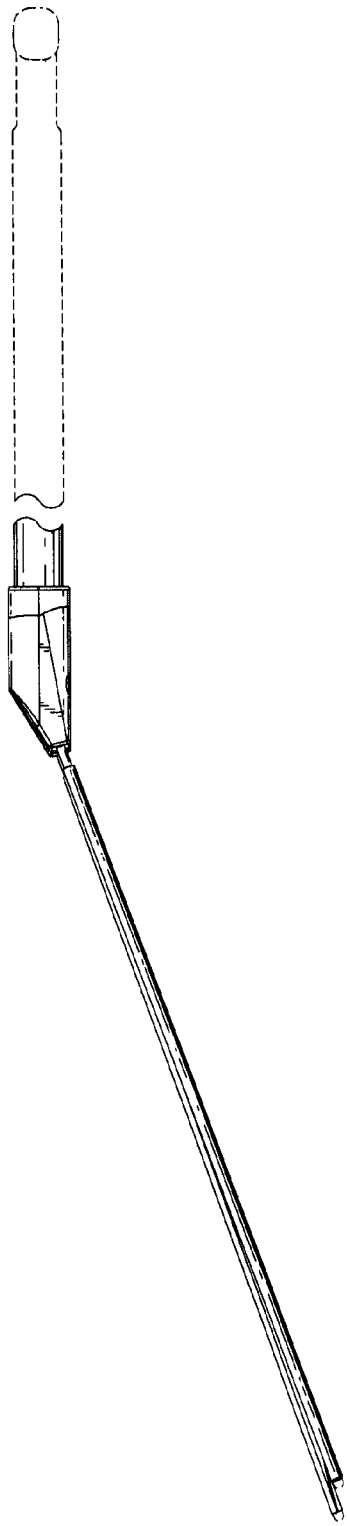
Figure 14C:
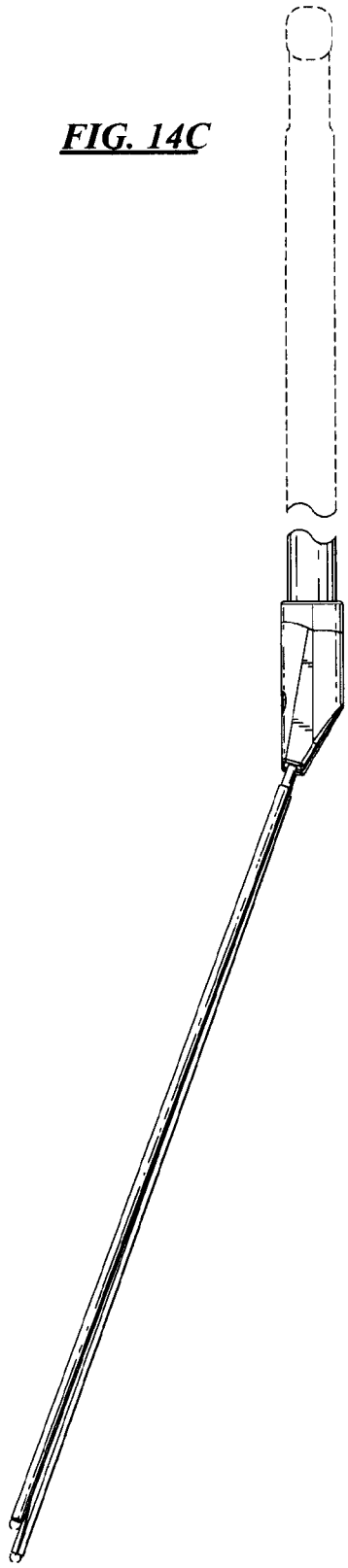
Figure 14D:
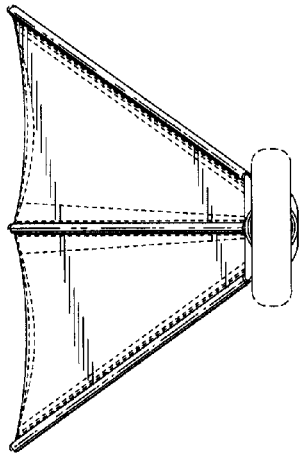
Figure 14E:
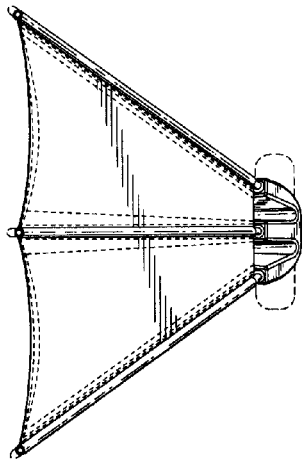
Figure 14F:
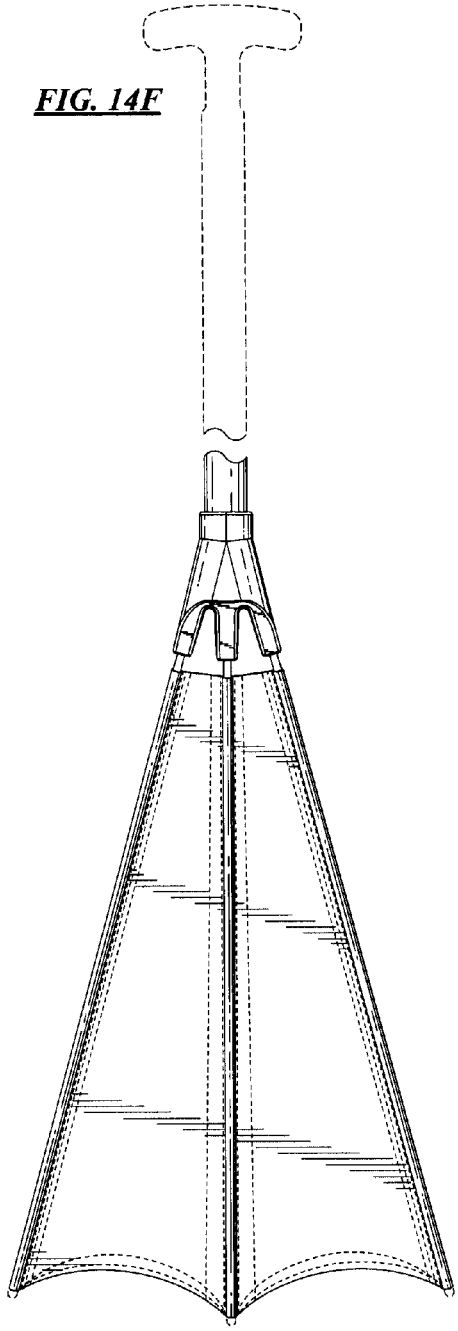
Figure 14G:
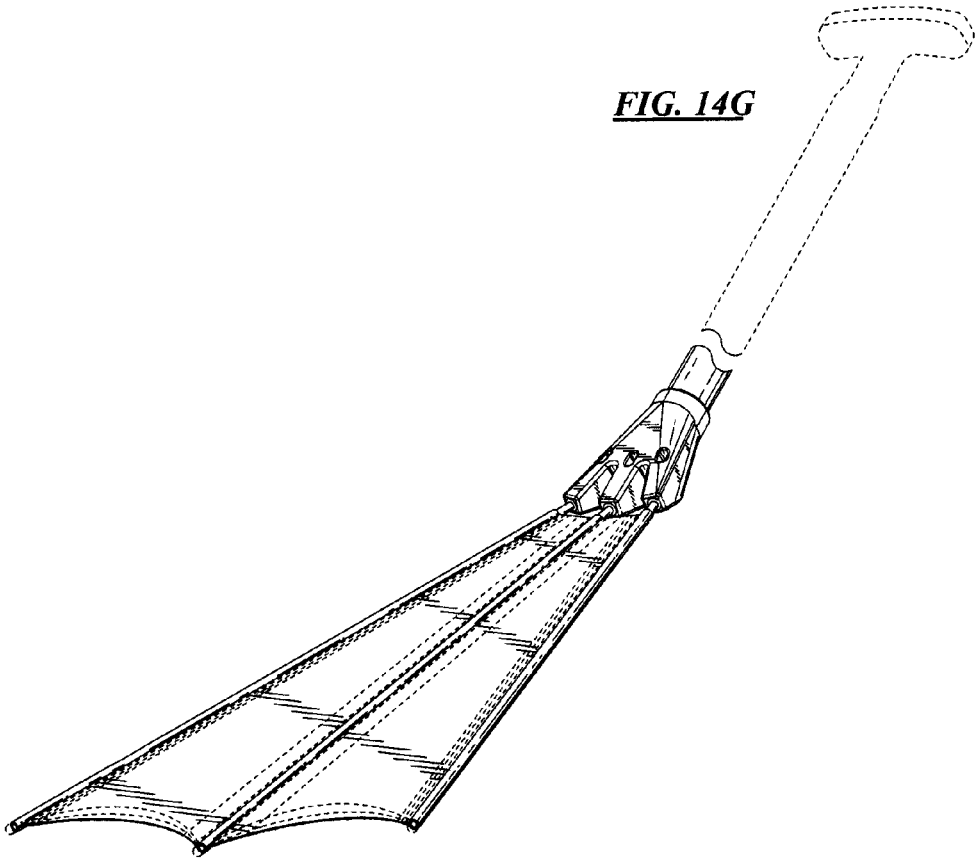

FIG. 11 is a flow diagram illustrating a method of assembling a paddle according to one aspect of the invention. At 1102, a shaft and hub structure are provided. The hub material can be selected from the table in FIG. 9B, or may be any other suitable material. The shaft can also be of any suitable material, although cost constraints for commercial embodiments may lead designers to select a lower-cost material such as aluminum. As discussed above, the shaft and hub can be from two separate materials, or can be integrally formed. In case where the hub structure and shaft are provided as separate parts, at 1104, they are rigidly coupled. This can be done, as described above, by fastening, welding, gluing, or otherwise mating the pieces together such that any relative movement between the parts is no more than negligible.

At 1106, rod members are provided according to the geometry and materials of FIG. 9A, or any other suitable geometry or material. At 1108, fabric sewn or otherwise formed into a web is provided. Material for the web may be selected from the table of FIG. 9C, or may be another suitable material. At 1110, the web fabric is engaged with the rod members. In constructing paddle 100, each of the rods is inserted into one sleeve in the web, and the distal ends are inserted into the retaining portions. At 1112, the rods are rigidly coupled to the hub structure. In one example embodiment, each of the rods is hammered into a receiving tapered bore in the hub structure. The assembled paddle may also receive either a handle at the proximal end, or a second paddle blade to be installed in the same sequence as the first paddle blade.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A paddle for propulsion of a human-powered watercraft through water, the paddle comprising:

a shaft having a first end and a second end; and a deformable paddle blade having a proximal end, a distal end, and a paddle face, the proximal end coupled to the first end of the shaft;

the paddle blade including a plurality of rods and a web spanning the rods, each of the rods having a first end coupled at the proximal end of the paddle blade, and a second end situated at the distal end of the paddle blade;

each of the plurality of rods being formed from a material and having dimensions that create a corresponding individual spring constant, wherein the paddle blade has an aggregated spring constant of between 250 N/m and 500 N/m defined as the sum of the individual spring constants of the plurality of rods, whereby the paddle blade is constructed to have sufficient elasticity and stiffness and a geometry such that:

during a power stroke, the paddle blade undergoes elastic deformation in response to water pressing against the paddle face whereby the paddle face changes from a generally flat form into a generally scoop-shaped channel that directs most of the water pressing against the paddle face to the distal end;

wherein the elastic deformation stores a portion of the power stroke's energy; and wherein at the end of the power stroke the portion of the power stroke's energy that is stored is released with sufficient force to aid in the propulsion of the watercraft; and during a recovery motion, the paddle face takes the generally flat form.

2. The paddle of claim 1, wherein the deformable paddle blade is rigidly coupled to the shaft.

3. An aquatic paddle for efficiently propelling a watercraft at a forward cruising velocity, the paddle comprising:

a shaft having a first end and a second end; and a paddle blade rigidly coupled to the first end of the shaft, the paddle blade being constructed from a skeleton and a web spanning the skeleton;

wherein the skeleton includes a hub structure having a proximal end and a distal end, and a plurality of rod members;

wherein each rod member of the plurality of rod members is rigidly secured at the distal end of the hub structure; and wherein the proximal end of the hub structure is rigidly secured to the first end of the shaft;

wherein the web is pivotably coupled to at least some of the plurality of rod members;

wherein the paddle blade is constructed to have an elasticity that corresponds to the watercraft such that, during a power stroke at the cruising velocity of the watercraft, the paddle blade undergoes elastic deformation in response to water pressing against the paddle blade whereby the paddle blade changes from a generally flat form into a generally scoop-shaped channel that directs most of the water pressing against the paddle blade to a distal end of the paddle blade; and wherein the paddle blade is further constructed to have a stiffness such that, at the end of the power stroke, the paddle blade returns to its generally flat form at a rate that exceeds the forward cruising velocity of the watercraft, such that the return to the generally flat form aids in propulsion of the watercraft.

4. The aquatic paddle of claim 3, wherein the plurality of rod members are generally co-planar with one another.

5. The aquatic paddle of claim 3, wherein the plurality of rod members protrude generally radially from the hub structure.

6. The aquatic paddle of claim 5, wherein the rod members are generally co-planar, and include a pair of outer rods oriented relative to one another with an angle of between 20 and 40 degrees.

7. The aquatic paddle of claim 3, wherein the paddle blade is oriented at an angle relative to the shaft.

8. The aquatic paddle of claim 7, wherein the paddle blade is oriented at an angle of between 160 and 170 degrees with the shaft, wherein the angle is defined in a plane generally perpendicular to a face of the paddle blade.

9. The aquatic paddle of claim 3, wherein the hub structure includes a rigid body coupled to the shaft, the rigid body having a plurality of cavities that engage respectively with the plurality of rod members.

10. The aquatic paddle of claim 9, wherein the plurality of cavities and the plurality of rod members are removably engaged.

11. The aquatic paddle of claim 3, wherein the hub structure is integrally formed with the shaft.

12. The aquatic paddle of claim 3, wherein the hub structure is removably coupled with the shaft.

13. The aquatic paddle of claim 3, wherein the web includes a fabric sheet on which are formed a plurality of sleeves; and wherein the plurality of rods are situated in the plurality of sleeves.

14. The aquatic paddle of claim 3, further comprising:

an additional paddle blade rigidly coupled to the second end of the shaft.

15. The aquatic paddle of claim 3, wherein the web includes a plurality of retaining portions, each of which covers an end of one of the plurality of rod members that is opposite the hub structure.

16. The aquatic paddle of claim 3, wherein the shaft includes an interior cavity and a retention structure adapted to carry at least one rod member in the interior cavity of the shaft.

17. A method for constructing an aquatic paddle having a paddle face, the method comprising:

providing a shaft and a hub structure rigidly situated at a first end of the shaft;

providing a plurality of stiff elastic rod members, each having an individual spring constant;

engaging a web fabric with the plurality of rod members such that the web fabric spans across the plurality of rod members, and the web fabric causes the plurality of rod members to collectively provide an aggregated spring constant for the paddle face of between 250 N/m and 500 N/m defined as the sum of the individual spring constants of the plurality rod members; and rigidly coupling the plurality of rod members to the hub structure such that the plurality of rod members protrude from the hub structure in a generally radial and co-planar configuration.

* * * * *